United States Patent [19]

Dahlke

[11] 4,250,490

[45] Feb. 10, 1981

[54] TWO WIRE TRANSMITTER FOR CONVERTING A VARYING SIGNAL FROM A REMOTE SENSOR TO A DC CURRENT SIGNAL

[75] Inventor: Charles J. Dahlke, New Germany, Minn.

[73] Assignee: Rosemount Inc., Eden Prairie, Minn.

[21] Appl. No.: 4,764

[22] Filed: Jan. 19, 1979

[51] Int. Cl.[3] ..... G08C 19/10; G06G 7/20

[52] U.S. Cl. ..... 340/870.37; 324/60 R; 73/141 R; 340/870.39

[58] Field of Search ..... 179/78 R, 78 A, 81 R; 340/200, 210; 73/141 R; 324/60 R, 61 R

[56] References Cited

U.S. PATENT DOCUMENTS

| | | | |
|---|---|---|---|
| 3,271,669 | 9/1966 | Lode | 324/60 |
| 3,318,153 | 5/1967 | Lode | 324/60 |
| 3,646,538 | 2/1972 | Frick | 340/200 |
| 3,680,384 | 8/1972 | Grindheim | 73/141 R |
| 3,854,039 | 12/1974 | Serrano | 340/200 |
| 3,859,594 | 1/1975 | Grindheim | 324/60 |
| 3,975,719 | 8/1976 | Frick | 340/200 |
| 3,997,733 | 12/1976 | Sanders | 179/81 R |
| 4,118,977 | 10/1978 | Olsen et al. | 73/141 R |
| 4,146,834 | 3/1979 | Maltby et al. | 340/210 |

*Primary Examiner*—Thomas A. Robinson

*Attorney, Agent, or Firm*—Kinney, Lange, Braddock, Westman and Fairbairn

[57] ABSTRACT

A two wire current transmitter provides a current signal representative of a parameter measured by a variable reactance sensor which may be located in a hostile environment, remote from the signal conditioning and transmitter electronics through transmission circuitry from the electronics including a separate transformer winding energized by a pair of twisted cables to reduce the capacitive, inductive and resistive effects of long wires. The transformer circuitry provides power to the sensor which provides the signal conditioning and transmitter electronics a signal, representing the parameter measured, which controls the current control, to modify the total current through the same two wires used to carry power to the signal conditioning and transmitter electronics, so that the total current is representative of the measured parameter.

14 Claims, 4 Drawing Figures

TWO WIRE TRANSMITTER FOR CONVERTING A VARYING SIGNAL FROM A REMOTE REACTANCE SENSOR TO A DC CURRENT SIGNAL

BACKGROUND OF THE INVENTION

1. Field of the Invention

This invention relates to a reactance measuring means which in one embodiment is a capacitance measuring means which provides an output suited to a reactance type pressure sensor, which sensor may be located non-adjacent to the signal conditioning and transmitter electronics which electronics control the current in two wires to be representative of the reactance of the variable reactance means.

2. Description of the Prior Art

Capacitance sensing circuitry which provides a DC signal proportional to capacitance has been described in U.S. Pat. Nos. 3,271,669, 3,318,153, 3,646,538, 3,854,039 and 3,975,719. Circuitry which provides control of direct current through a transmitter as a function of a DC signal is described in U.S. Pat. Nos. 3,859,594 and 3,680,384. Many industrial process indicators and controllers are in use which are scaled to respond to current from a DC two wire transmitter, so it has long been desirable to have a transmitter which in addition to converting a reactance sensor output such as from the capacitance pressure sensor or capacitance level sensor to control a direct current supplied to the transmitter, to also provide a variable reactance sensor remote from, or non-adjacent to, the signal conditioning and transmitter electronics, which sensor may be in a hostile environment, and which provides access to the signal conditioning and transmitter electronics without human exposure to such environment.

SUMMARY OF THE INVENTION

This invention comprises at least one variable reactance sensor, DC activated transmitter circuitry which supplies an alternating current for exciting the variable reactance sensor with a first transformer or direct coupling proximate to the DC activated transmitter circuitry and a second transformer proximate to the remote sensor, means providing for transmission of excitation to the remote variable reactance sensor, rectification means to provide a DC signal representative of the variable reactance to be measured, means for transmission of said DC signal to the transducer circuitry, and transmitter circuitry to control the total DC current as a function of the variable reactance being measured in the same two wires which provide DC power and a load to the transmitter terminals.

This invention provides circuitry which transmits excitation AC voltage from the signal conditioning and transmitter electronics to the varying reactance sensor and provides for transmission of the signal from the variable reactance sensor which is representative of the condition to be sensed to the signal conditioning and transmitter electronics of the transducer. The transmission means provides for mounting the variable reactance sensor proximate to a hostile environment such as a nuclear reactor or a chemical concentration remote from the signal conditioning and transmitter electronics. The first and the second transformer provide AC excitation to the remote sensor and the invention as disclosed reduces the effects of line to line and line to ground capacitance, inductance and resistance in the excitation circuit and in the DC signal circuit to improve performance of the remote sensor transmitter. Further advantageous use of the remote sensor capability is envisioned. This invention provides circuit means characterized to give highly linear DC output signal from a variable reactance sensor.

DESCRIPTION OF A PREFERRED EMBODIMENT

Figure 1:
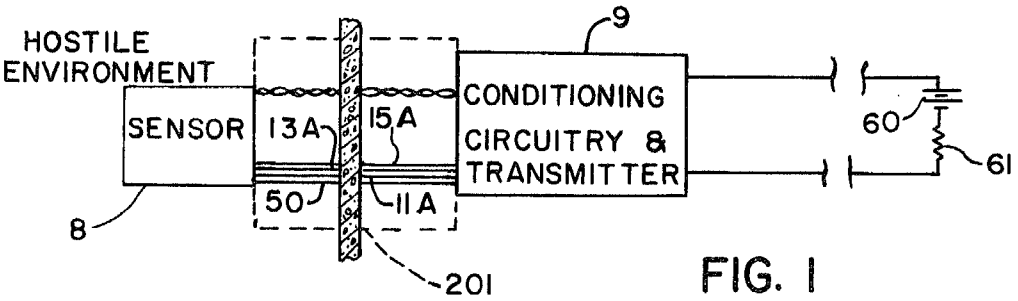
FIG. 1 is a block diagram representative of the remote sensor with the two wire transmitter and remote power supply and load.

The drawings show a block diagram representation FIG. 1 and a schematic diagram FIG. 1 of a circuit embodiment used in conjunction with a capacitive type differential pressure sensor which was shown and described in U.S. Pat. No. 3,646,538. The circuit functions as described in U.S. Pat. No. 3,646,538 and as described below.

For illustrative purposes a variable reactance sensor 8 is shown in a hostile environment and separated physically from the signal conditioning and transmitter circuit or electronics indicated at 9. Two wire transmitter and electronics 9 is connected by two wires to a serially connected source 60 and a load 61, which in turn may be remote from transmitter circuit or electronics 9.

The present invention provides a unique signal transmission means indicated at 201 which is arranged to minimize adverse effects of inductance, resistance and capacitance of the lines shown which form part of the transmission means.

Figure 2:
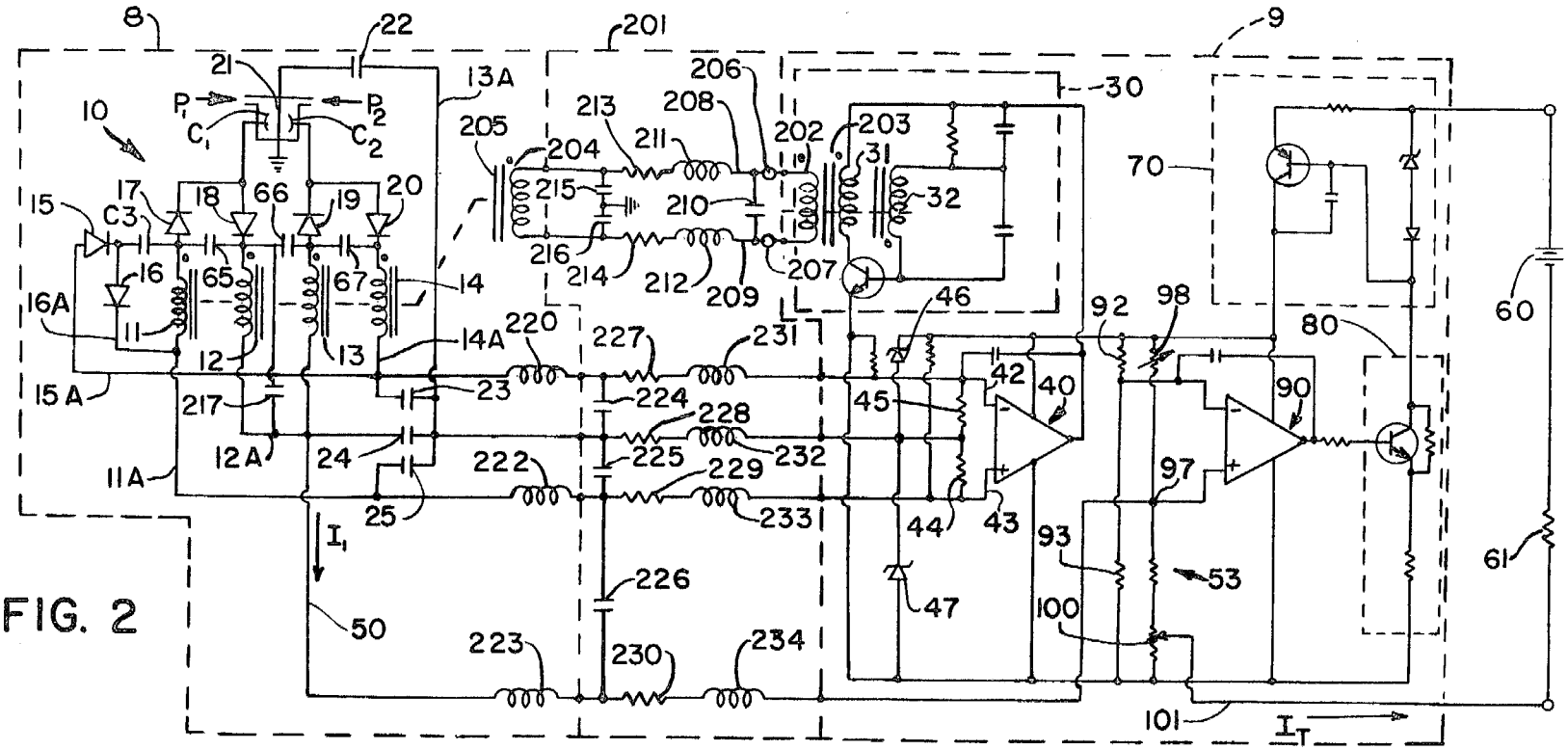
FIG. 2 is a schematic drawing of a circuit embodiment of the invention as used with a remote capacitance pressure sensor.

In FIG. 2 the lines in transmission means 201 are shown with equivalent inductors, resistors and capacitors for explanation of their respective effects on the sensor and how the effects are reduced.

As shown per FIG. 2, the sensor 8 includes a capacitance pressure sensor 10, the capacitance of which is to be measured, and this specific embodiment measurement circuit includes three capacitors, C1, C2, and C3. C1 and C2 are responsive to pressures $P_1$ and $P_2$ respectively. However, it should be clear that for some measurement applications the remote sensor may have only one active capacitor and in other instances there may be more than three capacitors involved in the measurement. Capacitors C1, C2, and C3 are respectively excited or charged to opposite polarities by secondary transformer windings 11, 12, 13 and 14 which are all closely coupled in phase and amplitude and which are in circuit with the respective diodes 15, 16, 17, 18, 19 and 20. Capacitors 22, 23, 24, and 25 provide AC coupling to the capacitors C1 and C2 while maintaining DC isolation where required. Each of the capacitors C1, C2, and C3 has a pair of diodes associated with it, where one diode allows the charging current to flow to the capacitor in one direction, or polarity, only and the other of the two diodes allows a charging current to flow to the capacitor in an opposite direction, or polarity, only. The charging currents associated with an individual capacitor are then pulsating DC signals having an average current amplitude directly proportional to the product of the applied peak voltage, frequency, and capacitance so long as the peak voltages are of sufficient duration to substantially fully charge the capacitors during each cycle and neglecting the forward voltage drop of the diodes. The polarity of the charging currents are defined by the diodes. Such circuitry has been previously described in U.S. Pat. No. 3,646,538 and in U.S. Pat. Nos. 3,271,669 and 3,318,153. The currents from the capacitors C1, C2 and C3 may be filtered and smoothed for example by capacitors 23, 24, and 25 across resistors 45 and 44 in transmitter 9 respectively, and the currents may be then subjected to prescribed arithmetic operations as addition, subtraction, multiplication, and division.

The output signals from the sensor 8 are DC current signals and are carried from the sensor to transmitter 9 by lines 11A, 15A and 50. The DC currents on lines 11A and 15A are used to control oscillator 30 and the resultant excitation to sensor 8, and the current on line 50 indicates the value of the parameter measured. Power to the circuitry is provided from the DC supply 60 through a terminal to signal conditioning and transmitter electronics 9 including a current source 70 which provides current to subsequent circuitry. Transmitter 9 also includes an oscillator control amplifier 40 which drives and controls output of oscillator 30. Oscillator 30, through transmission means 201 provides the excitation for the remote sensor through a first transformer 203 which includes a primary winding 31 magnetically coupled to feedback winding 32 and a secondary winding 202. Transformer 203 is mounted with the transmitter 9. The function of first transformer 203 may be accomplished by direct coupling or other means.

A second transformer 205 remotely mounted with sensor 8 includes primary winding 204 magnetically coupled to sensor excitation windings 11, 12, 13 and 14, which in U.S. Pat. No. 3,646,538 were the secondary windings of the sole transformer utilized therein.

Secondary winding 202 of transformer 203 is excited by oscillator 30 through primary winding 31. Secondary transformer winding 202 is connected to a pair of terminals 206 and 207 which are connected in turn to a pair of wires 208 and 209 which may be twisted and shielded and which extend to remote sensor 8 and are connected to primary transformer winding 204 of transformer 205. Wires 208 and 209 are elongated to permit winding 204 to be remote from winding 202 and thus non-adjacent to transmitter 9.

Usually, elongated lines between transmitters and remote sensors provide errors because of inductive, capacitive and resistive effects of these lines. As will be shown the transformer arrangement herein reduces these effects so they are not detrimental to operation.

Equivalent line capacitance, inductance and resistance in FIG. 2 are represented for the lines comprising transmission means 201. Capacitor 210 represents the line to line capacitance between lines 208 and 209. The inductors 211 and 212 and the resistors 213 and 214 represent the series inductance and series resistance of lines 208 and 209 respectively. The capacitors 215 and 216 represent the line to ground capacitance of lines 208 and 209 respectively. Line to line capacitance 210 and line to ground capacitances 215 and 216 is represented across secondary winding 12 as a capacitor 217. The value of equivalent capacitor 217 ($C_{217}$) is a function of capacitors 210, 215 and 216 and of the turns ratio of transformer 205 squared, (using secondary winding 12 as an example) that is $$C_{217} = \text{fct'n of } (C_{210} + C_{215} + C_{216}) \left(\frac{N_{204}}{N_{12}}\right)^2.$$

The turns ratio of transformer 205 may be typically 1 to B 4, hence capacitor 217 when the line capacitance is multiplied by the turns ratio squared, is reduced by a factor of 16 from the line capacitance.

It should also be observed that $C_{217}$ does not affect the pressure sensitive capacitance C1 or C2 and does not affect signals detected by diodes 15, 16, 17, 18, 19 and 20, and therefore will only contribute to frequency shift errors. The primary factors controlling oscillator frequency are transformer 205 secondary inductance and capacitors $C_{217}$, $C_1$, $C_2$ and $C_3$. The frequency shift errors are small because after the initial ZERO and SPAN adjustment at resistors 98 and 100 in transmitter 9 respectively, to remove capacitance 210, 215 and 216 frequency shift effects, only a change in $C_{210}$, $C_{215}$ and $C_{216}$ that is, $\Delta C_{210}$, $\Delta C_{215}$ and $\Delta C_{216}$ due to a change in external conditions on the lines will cause a frequency shift error. Expressed in another way, $$(\Delta C_{210} + \Delta C_{215} + \Delta C_{216}) \left(\frac{N_{204}}{N_{12}}\right)^2 = \Delta C_{217} \text{ which is } << (C_{217} + C_1 + C_2 + C_3)$$

so the frequency shift error is small. $C_{217}$ may be expressed as the capacitance represented across each of the secondary windings 11, 12, 13 and 14 as these windings are all AC coupled together by capacitors 65, 66 and 67. Thus, the capacitance effects of lines 208 and 209 will not significantly affect transmitter 9 output with transformer 205 mounted with sensor 8.

The equivalent line inductance 211 and 212 is multiplied by $(N_{12}/N_{204})^2$ and is added as inductance in each secondary winding of transformer 205. Normally this would cause a frequency shift error if the total effect of the primary side inductance was present in lines 15A, 11A and 50. However, since the wires 208 and 209 may be twisted and in close proximity to one another, the individual inductive effects of wires 208 and 209 tend to cancel each other. Hence, only the uncancelled inductance multiplied by for example $(N_{12}/N_{204})^2$ is added to the respective secondary as series inductances 220, 222 and 223 respectively. The net effect of this frequency shift error is very small.

Resistors 213 and 214 representing the resistance of lines 208 and 209 are in the control loop for oscillator 30. Resistors 213 and 214 increase control loop power dissipation resulting in oscillator 30 current increase. This indicates that there is a practical limit on the length and wire size of lines 208 and 209, if oscillator control 40 is to maintain control.

Lines 15A, 11A and 50 carry filtered DC currents from the diodes, which form a rectifier means, from sensor 10. Capacitors 224, 225 and 226 represent the line to line capacitance of lines 15A, 11A and 50, aid in filtering the detected DC currents. The equivalent resistance of these lines is represented by the resistors 227, 229 and 230. Resistors 227,229 and 230 carry the detected DC currents which are representative of the condition to be sensed. This results in voltage drops across these lead wire resistors 227, 229 and 230 but does not change the current through these wires. Similarly, since currents in lines 15A, 11A and 50 are DC, the line equivalent inductances represented by inductors 231, 233 and 234 have no reactive impedance component and therefore will have only a small transient effect on the detected DC currents.

The resultant DC currents in lines 15A and 11A are applied through transmission means 201 at input terminals 42 and 43 of operational amplifier 40 which controls oscillator 30. Transmitter current control stage 80 which controls the total current flowing in the two wires connected to source 60 and load 61 is regulated by the output of a differential input of operational amplifier 90 which is responsive to a combination of current input signal $I_1$ on line 50 and a known portion of the total transmitter current $I_T$ which is present on line 101 at summing node 97 at one input of amplifier 90 and a reference voltage established by zener diodes 46 and 47 and resistors 92 and 93 at its inverting input. This combining of current to provide a resultant signal from amplifier 90 and current control 80 as a function of $I_1$ and $I_T$ is accomplished in the resistance network indicated generally at 53. $I_T$ then passes through an external terminal to external load resistor 61 and to DC supply 60 completing the DC two wire circuit.

Line 13A is an AC return. Equivalent resistance 228 is small and have very little effect in the circuit. Equivalent inductance 232 cancels a portion of the effect of capacitor 22 and, hence, decreases the impedance of the AC return.

Transmitter 9, the circuitry associated with oscillator 30, amplifier 40, current control stage 80, amplifier 90, network 53 and the connections to load 61 and supply 60 are schematically disclosed herein and are fully described in U.S. Pat. No. 3,646,538: the pertinent portions of such patent are thus incorporated herein by reference.

Figure 3:
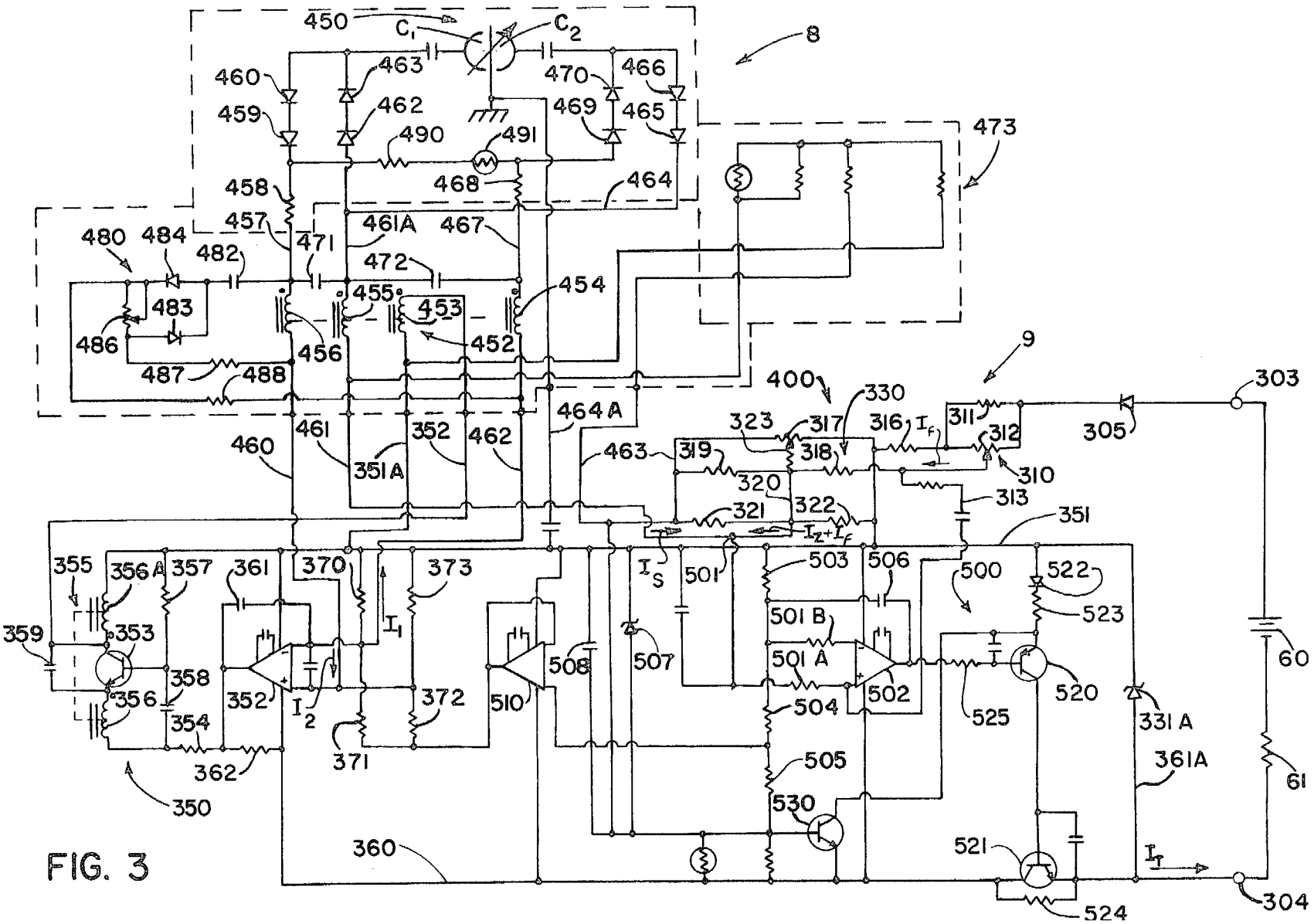
FIG. 3 is another schematic drawing of a circuit embodiment of the invention as used with a remote capacitance pressure sensor.

FIG. 3 is another embodiment of the present invention. The transmitter 9 is a modified form of circuitry. As explained in the foregoing this two wire transmitter has two main components, the signal conditioning and transmitter circuit or electronics shown in this form at 400, a remote sensor 8 located non-adjacent to signal conditioning and transmitter electronics 400 for measuring a parameter to be sensed and an external DC supply 60 and load 61. The general arrangement is in accordance with FIG. 1. A pair of terminals 303 and 304 at signal conditioning and transmitter electronics 400 provide for a two wire connection to external DC supply 60 and a serially connected external load 61. A phase reversal protection diode 305 connects to terminal 303 and SPAN and ZERO adjustment resistande networks 310 and 330 respectively are connected to the line 351 of signal conditioning and transmitter electronics 400. Line 351 is connected to an oscillator circuit illustrated generally at 350. In this embodiment oscillator 350 is directly coupled through a pair of lines 351A and 352 which provide excitation to sensor 8, however, a transformer secondary or other coupling means may also be suitable. The line 351A is connected to line 351.

Remote sensor network 8 provides output DC signals represenatative of the sensed parameter which are carried back to the signal conditioning and transmitter electronics 400 through three lines 460, 461 and 462, lines 351A and 463 provide for DC ZERO compensaion and an AC return for the sensor module 450 is provided through a line 464A.

Signal conditioning and transmitter electronics 400 also comprise a current control 500 which adjusts the current passing through the two wires on terminals 303 and 304 and through serially connected external load 61 and power supply 60 as a function of the parameter to be sensed.

In operation, oscillator 350 provides repetitive charging and discharging currents or current pulses to each of the capacitors C1 and C2. Oscillator 350 output is the constant product of frequency, voltage peak to peak and capacitance $(C_1+C_2)$ and is controlled by the voltages at the inputs to the amplifier 352. Amplifier 352 is connected to the emitter of transistor 353 through a coupling resistor 354 and feedback winding 356 of the transformer 355. Primary winding 356A of transformer 355 is connected to line 351. The base of transistor 353 is connected to line 351 (and also line 351A) through a resistor 357 and is connected through a capacitor 358 between feedback winding 356 and coupling resistor 354. Capacitor 359 is connected across the collector and emitter of transistor 353 to control the Meissner mode of operation of oscillator 350. Amplifier 352 is connected to line 351 and a line 360 for power. Zener diodes 331A is connected between lines 351 and 361A for transient suppression. A capacitor 361 provides feedback for amplifier 352. A resistor 362 provides a parallel path for transistor 353 current through resistor 354.

Lines 351A and 352 are directly coupled across primary winding 356A and provide a path for the pulsating currents from oscillator 350 to provide excitation to a second transformer 452 which has a primary 453 and three secondaries 454, 455 and 456 respectively. Lines 351A and 352 correspond in funcion to lines 208 and 209 in FIG. 2 and relevant equivalent capacitance, inductance and resistance thereto. These secondary windings 454, 455, and 456 provide excitation for sensor capacitor C1 through line 457, resistor 458 and diodes 459 and 460 and through a line 461A and diodes 462 and 463 respectively; and for sensor capacitor C2 through line 464 and diodes 465 and 466 and through another line 467, resistor 468 and diodes 469 and 470 respectively. The operation of the transformer, the diodes and the capacitors is explained in U.S. Pat. No. 3,318,153 (T. Lode) which is incorporated herein by reference. Capacitors 471 and 472 insure secondaries 454, 455, 456 are in phase. A ZERO temperature compensation network 473 is coupled to line 351A and 463, the compensation current being carried to the transmitter and signal conditioning electronics 400 through line 461. A linearity network 480 comprised of a capacitor 482, a pair of diodes 483 and 484 across the potentiometer 486 coupled to two resistors 487 and 488 respectively compensates for the non-linear change of capacitance of capacitors C1 and C2 with the parameter to be sensed. Resistors 458, 468 and 490 and temperature sensitive resistor 491 provide SPAN temperature compensation for capacitors C1 and C2. Linearity network 480 may also be located adjacent to transmitter 400 as shown in FIG. 4.

Figure 4:
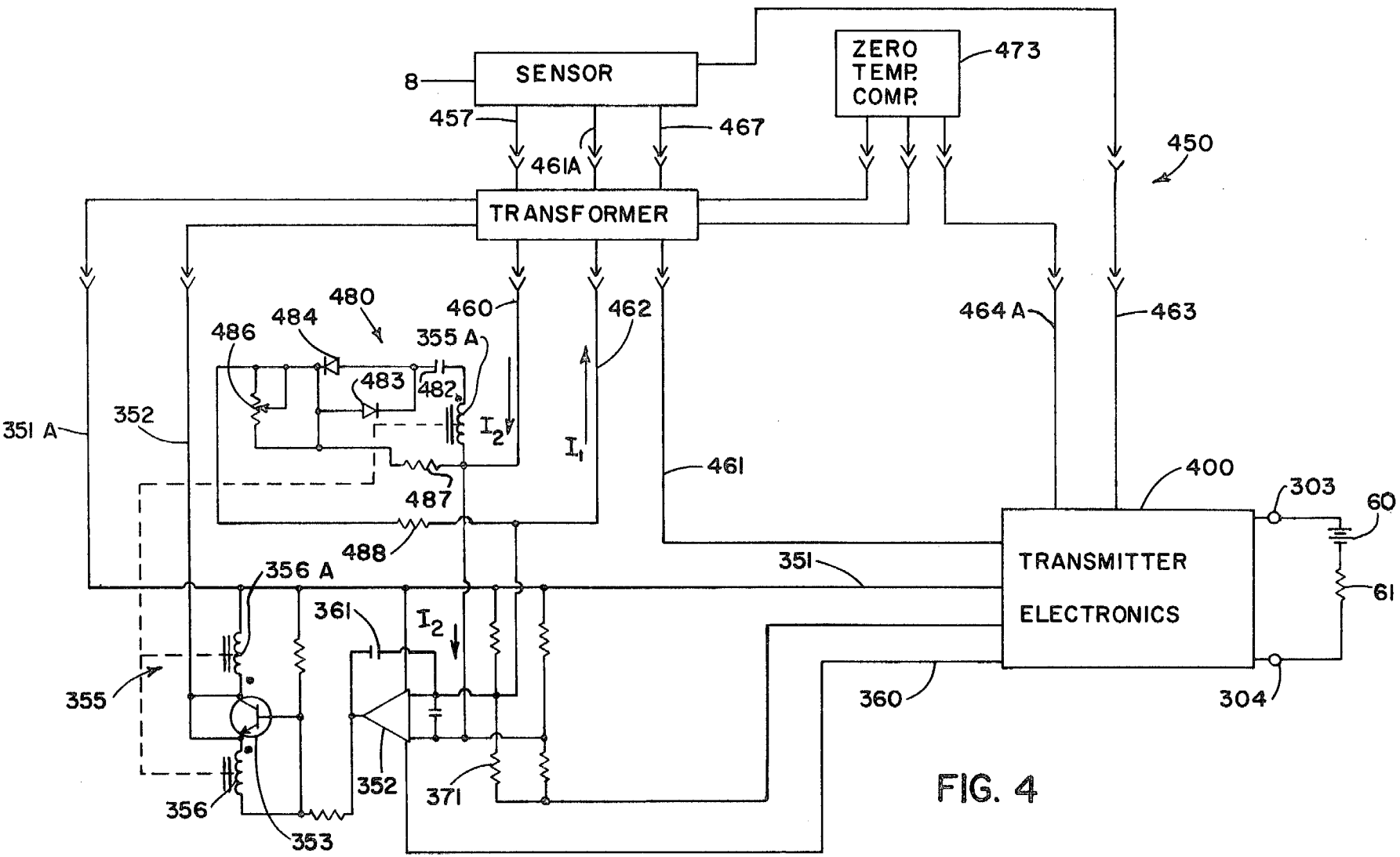
FIG. 4 is another schematic drawing of a circuit embodiment of FIG. 3 wherein a linearity network is mounted adjacent to the signal conditioning and transmitter electronics.

Referring to FIG. 4 transformer 355 has a secondary winding 355A magnetically coupled to primary 356A and feedback 356 windings which is coupled to lines 460 and 462, hence providing for adjustment of the linearity resistor 486 adjacent transmitter 400. It should be observed that linearity network 480, SPAN and ZERO temperature compensation networks are conventional compensation schemes and function independent of whether or not sensor module 450 is mounted adjacent or non-adjacent to signal conditioning and transmitter electronics 400. The mounting of the SPAN and ZERO compensation networks adjacent to capacitors C1 and C2 provides for appropriate ZERO and SPAN compensation for known errors as the corrective elements are in the same environment as capacitors C1 and C2, while the signal conditioning and transmitter electronics 400 may be mounted non-adjacent to sensor module 450.

Referring again to FIG. 3 the DC currents responsive to the change of the parameter to be sensed and corrected for temperature and linearity are carried back to the signal and conditioning transmitter electronics through lines 460, 461 and 462, respectively. In FIG. 3 capacitors are shown in the lines leading to C1 and C2. These are large capacitors (for example 100 times C1 and C2) which are to prevent shorting if C1 and C2 are in an over pressure condition.

Lines 462 and 460 carry $I_1$ and $I_2$ respectively and effectively correspond to the functions of lines 11A and 15A of FIG. 2. The output of operational amplifier 352 has a first control signal at its inverting input of $I_1$ through resistors 370 and 371, and a second control signal at its non-inverting input of $I_2$ through resistors 372 and 373. The output at amplifier 352 then controls the frequency and the peak to peak voltage of oscillator 350 responsive to said first and second control signals. Line 461 provides a return for $I_2$–$I_1$ corresponding to line 50 of FIG. 2.

Current control 500 operates similar to the current control described in U.S. Pat. No. 3,975,719 incorporated herein by reference. The SPAN network 310 includes a potentiometer 312 and a parallel resistor 311 connected from diode 305 to resistor 316 which in turn is connected to the zero network 330. Resistor 316 is connected to potentiometer 317 which is connected in parallel with a pair of resistors 321 and 322 to line 463. The line connecting resistors 316 and 322 and one end of potentiometer 317 is connected to line 351.

The wiper of potentiometer 312 is connected to a resistor 318 which is connected in series with a resistor 319 to line 463. The junction between resistors 318 and 319 is connected to one end of a resistor 323, which is connected to the wiper of potentiometer 317, and to a line 320 which is connected to the junction of resistors 321 and 322 and leads to a circuit node 501 which is also connected to line 461 (carrying the sensor current $I_s$). Node 501 is connected through a resistor 501A to the non-inverting input of current control operational amplifier 502.

The wiper of SPAN potentiometer 312 is set so that a very small but known portion of the total current, $I_T$, called the feedback current $I_f$ is carried through resistor 318 to line 320 and is added to a zero current, $I_z$, from network 330 also carried in line 320. These two currents $I_f$ and $I_z$ are carried to node 501 and added to the sensor current, $I_s$, from line 461 to provide a control signal to the non-inverting input of amplifier 502. Line 461 corresponds to line 50 of FIG. 2.

A second (inverting) input of amplifier 502 is connected through resistor 501B to sense a reference voltage at a junction between resistors 503 and 504 which, together with resistor 505, comprise a voltage divider network. A feedback capacitor 506 is connected from the output of amplifier 502 through resistor 501B to its inverting input. A zener diode 507, capacitor 508 and a transistor 530 provide a reference voltage for the divider network comprised of resistors 503, 504 and 505. The output of amplifier 502 then provides an output signal, corrected for linearity with SPAN and ZERO compensation, representative of the condition to be sensed. Suitable damping is provided by a series resistor and capacitor in line 313 and other standard filtering and compensating components may be provided as shown.

One input of a buffer amplifier 510 is connected between resistors 504 and 505 and the amplifier 510 provides a reference voltage to amplifier 352. Transistor 520 is connected through its base and a resistor 525 to the output of amplifier 502. Transistor 520 is used in a common emitter configuration and provides gain from amplifier 502 to output transistor 521. The emitter of transistor 520 is connected through a diode 522 and a resistor 523 to line 351 for current limiting. The base of transistor 521 is controlled as a function of the output of amplifier 502 and the collector current of transistor 520, thus transistor 521 controls loop current as a function of the parameter to be sensed. Resistor 524 is connected across the collector and emitter of transistor 521 providing a shunt current path which enables the normally off transistor 521 to be initialized by low lift off voltage. Transistor 530 regulates the current for reference voltage diode 507 and further provides a shunt path in combination with resistor 523 a path for excess transmitter current.

It should be observed that terminals are provided in lines 351A, 352, 460, 461, 462, 463 and 464A to provide for the separation of sensor module 450 from the signal conditioning and transmitter electronics 400 through those lines. The foregoing analysis from the first explained embodiment herein, concerning the effects of the capacitance, inductance, and resistance on the elongated wires 351A, 352, 460, 461, 462, 463 and 464A have not again been discussed, however, the similar results are evident. The present embodiments disclose excitation power coupled to sensor module 450 by means of a direct coupling means rather than a transformer secondary as described in the previous embodiment. This circuit modification does not alter the analysis of the effects of capacitance, inductance or resistance on the circuit. Frequency shift errors are small as the SPAN 310 and ZERO 330 adjustments at resistors 312 and 317 respectively accomodate changes in capacitance except changes due to external conditions as hereinbefore explained with relation to FIG. 2.

It is observed that the addition of a remote sensor capability described herein provides for the sensor to be mounted in a hostile environment, for example, an area of nuclear radiation which would normally cause erratic operation of operational amplifiers, transistors and components normally associated with two wire transmitters. With the technique described herein, electronic components affected by hostile environments such as nuclear radiation may be mounted in a "clean room" where nuclear radiation is at a tolerable level for sensitive components.

The remote mounting of the sensor also provides for the sensor to be located in a hostile environment such as an area of chemical concentration which may be dangerous to human life and provides for mounting the signal conditioning and transmitter electronics in a "clean room" so that adjustment and calibration to the two wire transmitter electronics may be safely accomplished.

The remote mounting of the sensor further provides for calibration of the transmitter electronics from a readily physically accessible area while the sensor may be mounted in a relatively inaccessible position. Further beneficial utility is envisioned.

EXAMPLE

As a specific example of operation of the circuitry disclosed in FIGS. 1, 3 and 4 herein (the secondary 355A was located as shown in FIG. 4), circuit components were selected for use with a differential pressure sensor having a change in capacitance of about 300 pf. Capacitors $C_1$ and $C_2$ individually were approximately 150 pf. The individual circuit component values are listed in Table I below. With the specific component values shown and a minimum voltage supply of about 22 volts between terminals 303 and 304, the total current $I_T$ can be 4–20 milliamperes for a ZERO pressure to full scale pressure excursion. The circuit of FIG. 4 then performed to expectations and the effects of the elongated lead wires 351A, 352, 460, 461, 462, 463 and 464 was minimal to $I_T$.

A demonstration was conducted wherein the signal conditioning and transmitter electronics 400 was located non-adjacent to sensor 8 through approximately two hundred and fifty nine meters of wire by means of a ten conductor twenty two AWG cable of which seven conductors were used for the demonstration. Table II provides data in Column 1 wherein said sensor 8 and said transmitter 400 were adjacent and in Column 2 wherein they were spaced apart and the cable was interposed. It should be noted that the results in Column 2 contain small frequency shift errors and substantially all of these errors can be corrected by adjustment of the ZERO to SPAN networks.

In FIG. 2 the black dots at the intersections of the dotted line outline of transmission means 201 and each of the leads or wires included in the transmission means, represent connectors. Also connectors are represented in FIG. 4 in each of the lines leading to the sensor for illustrative purposes.

TABLE I

| | SYMBOL | VALUE AND/OR TYPE |
|---|---|---|
| Capacitors | 358 | .0033 μf |
| | 359 | 470 pf |
| | 361 | .1 μf |
| | 367 | .1 μf |
| | 471 | .1 μf |
| | 472 | .1 μf |
| | 506 | .1 μf |
| | 508 | 1 μf |
| Resistors | 311 | 180 Ω |
| | 312 | 2K |
| | 314 | 94 Ω |
| | 316 | 15 Ω |
| | 317 | 20K |
| | 318 | 16.2K |
| | 319 | 48.7K |
| | 321 | 36.5K |
| | 322 | 12.4K |
| | 351 | 150K |
| | 354 | 100 Ω |
| | 357 | 150K |
| | 362 | 8.2K |
| | 370 | 10K |
| | 371 | 60.4K |
| | 372 | 10K |
| | 373 | 60.4K |
| | 458 | |
| | 468 | |
| | 486 | 20K |

TABLE I-continued

| | SYMBOL | VALUE AND/OR TYPE |
|---|---|---|
| | 487 | 10K |
| | 488 | 10K |
| | 490 | 4.7K |
| | 491 | 10K |
| | 501B | 1M |
| | 501A | 1M |
| | 503 | 10K |
| | 504 | 10K |
| | 505 | 20K |
| | 523 | 220 Ω |
| | 524 | 13K |
| Diodes | 305 | IN4003 |
| | 331A | IN4761 |
| | 459,460,462,463,465,466, 469,470,483,484 | IN914 |
| | 507 | IN457 |
| Transistors | 353 | 2N4124 |
| | 520 | MPS-L51 |
| | 521 | MJE-340 |
| | 530 | 2N4124 |
| Amplifiers | 352,502,510 | LM308 |
| Transformer Windings | 356A/453 | Primary 69 turns |
| | 356 | Feedback 6 turns |
| | 453 | P. Core |
| | 355A | Secondary 300 turns |
| | 454,455,456 | Core, Toroid (Ferrite) Magnetics Inc. A-41407-TC-OT Ferroxcube 768T188/303 |

TABLE II

| % FULL SCALE PRESSURE | VOLTAGE OUTPUT ACROSS RESISTOR 61: ELECTRONICS 400 & SENSOR 8 ADJACENT | VOLTAGE OUTPUT ACROSS RESISTOR 61: ELECTRONICS 400 & SENSOR 8 THRU 259 METERS OF CABLE |
|---|---|---|
| 0 | 1.999 | 1.968 |
| 20 | 3.597 | 3.561 |
| 40 | 5.198 | 5.186 |
| 60 | 6.797 | 6.794 |
| 80 | 8.397 | 8.400 |
| 100 | 9.998 | 10.008 |

What I claim is:

1. An improved two wire current transmitter having a pair of terminals for connection through two wires to an external DC power supply means serially connected to an external load, said transmitter including a DC signal conditioning circuit having an oscillator and current control means for controlling current at said terminals, a remote sensor for measuring a change in parameter to be sensed mounted in position spaced substantially from said DC signal conditioning circuit and including means providing a direct current output signal, and means for coupling said sensor to said DC signal conditioning circuit to provide the direct current output to said DC signal conditioning circuit, wherein the improvement comprises a first transformer secondary located proximate to said DC signal conditioning circuit and coupled to the output of said oscillator, and a second transformer located proximate to said sensor and coupled to said first transformer secondary for providing excitation from said oscillator to said sensor, and said sensor further being coupled by elongated lines to said current control means for providing the direct current output to control the current at said terminals as a function of the change of said parameter.

2. A two wire current transmitter having a pair of terminals for connection to an external DC power supply means serially connected to an external load through two wires, DC current source means coupled to a first of said terminals, oscillator means coupled to said DC current source, reactive sensor means responsive to a physical parameter located non-adjacent and coupled to said oscillator means, rectification means coupled to and located adjacent to said sensor for providing a DC signal, transmission means for coupling said oscillator means and said sensor means to provide excitation thereto, DC current control means coupled to said rectification means, said rectification means providing DC signals representing said physical parameter to said current control means, said current control means further being coupled to said DC current source means and to a second of said terminals to provide a DC current in two wires connected to said terminals responsive to said parameter, wherein the improvement comprises said transmission means having a transformer adjacent to said sensor means and non-adjacent to said oscillator means for coupling excitation signals from said oscillator means to said sensor means and for reducing excessive lead wire effects of capacitance, inductance and resistance which normally result from long transmission lines.

3. An improved two wire transmitter in accordance with claim 2 wherein said transmission means further comprises a second transformer secondary coupled with and adjacent to said oscillator.

4. An improved two wire transmitter in accordance with claim 2 wherein said transmission means further comprises means for direct coupling from said oscillator to said transformer.

5. A two wire transmitter for providing a direct current signal proportional to a condition to be measured comprising a pair of excitation terminals for connection to direct current supply means and a serially connected load, AC reactive impedance means which varies as a function of the condition to be measured, oscillator means energized by current drawn through the excitation terminals and having its output coupled to the AC impedance means for applying an alternating current therethrough, current rectification means in circuit with the oscillator means and AC impedance means to provide a first DC signal representative of the magnitude of the AC impedance, a reference DC means which provides a second DC signal independent of the variable AC impedance, a current control amplifier means having input signal terminals and providing an output signal in response to a signal at its input terminals and which is energized by current drawn through the excitation terminals, current control means connected between the excitation terminals and controlling the current drawn therethrough in response to the control signal, a first network means, including means summing the total direct current drawn through the excitation terminals for comparison of the first and second DC signals and a DC signal representing at least a portion of the total direct current flowing through a resistance, and means connecting the network means to the amplifier input signal terminals so that a control signal is produced which adjusts the current through the control means to provide a prescribed relation between total direct current and the condition to be measured, wherein the improvement comprises a transmission means coupled between said AC reactive impedance means and said oscillator means.

6. Apparatus according to claim 5 wherein the improvement further comprises a transformer adjacent to said AC reactive impedance and coupled thereto for providing for said sensor and said current rectification means and said transformer to be disposed non-adjacent to said oscillator.

7. Apparatus according to claim 6 wherein said transmission means further provides excitation from said oscillator to said sensor.

8. Apparatus according to claims 5, 6 or 7 wherein said transmission means provides reduced effects of capacitance, inductance, and resistance of said non-adjacent disposition of said sensor from said oscillator.

9. An improved two wire current transmitter of the type in which a pair of terminals is provided for connection on a first side to an external current supply means and a load, a variable reactance sensor located non-adjacent said transmitter, an oscillator coupled to a second side of said terminal and to said non-adjacent variable reactance sensor to provide excitation to said sensor, said transmitter including a current control to control current through said terminals, said sensor providing a DC signal representative of the measured parameter back to said current control of said transmitter to adjust the current through said terminals as a function of the measured parameter wherein the improvement comprises first means mounted with said transmitter and excited by said oscillator, a transformer having a primary winding mounted with said sensor, means for coupling said first means and said primary means for receiving power from said oscillator and for providing excitation to said non-adjacent sensor, means connected to said sensor to carry a signal from said sensor to said oscillator and said current control of said transmitter.

10. The transmitter of claim 9 wherein said first means includes a transformer having a secondary, said means for coupling comprising a twisted pair of wires coupling said secondary to said primary.

11. The transmitter of claim 10 wherein said sensor includes rectification means providing only direct current signals from said sensor to said oscillator and current control.

12. Apparatus according to claim 9 further wherein the first means further comprises a second transformer secondary.

13. Apparatus according to claim 9 wherein the first means further comprises direct coupling.

14. Apparatus according to claims 9, 10, or 11 wherein first means further comprises means for exciting an adjacent linearity network.

* * * * *